US006745755B2

(12) United States Patent
Piccini

(10) Patent No.: US 6,745,755 B2
(45) Date of Patent: Jun. 8, 2004

(54) MAGAZINE WITH A PLURALITY OF CYLINDERS IN SERIES, IN PARTICULAR FOR COMPRESSED-AIR GUNS

(75) Inventor: Carlo Piccini, Brescia (IT)

(73) Assignee: Valtro Europe S.r.l., Brescia (IT)

( * ) Notice: Subject to any disclaimer, the term of this patent is extended or adjusted under 35 U.S.C. 154(b) by 0 days.

(21) Appl. No.: 10/652,187

(22) Filed: Aug. 29, 2003

(65) Prior Publication Data

US 2004/0079352 A1 Apr. 29, 2004

(30) Foreign Application Priority Data

Aug. 29, 2002 (IT) ..... BS2002A0076

(51) Int. Cl.[7] ..... F41B 11/02
(52) U.S. Cl. ..... 124/49
(58) Field of Search ..... 124/45, 48, 73, 124/74

(56) References Cited

U.S. PATENT DOCUMENTS 2,237,678 A * 4/1941 Lohr et al. ..... 124/66
4,422,433 A * 12/1983 Milliman ..... 124/74
4,986,251 A * 1/1991 Lilley ..... 124/67
5,160,795 A * 11/1992 Milliman ..... 42/65
6,470,871 B2 * 10/2002 Casas-Salva ..... 124/48

* cited by examiner

*Primary Examiner*—John A. Ricci
(74) *Attorney, Agent, or Firm*—McGlew and Tuttle, P.C.

(57) ABSTRACT

The subject of the present invention is a magazine of shots for repeating guns, in particular for compressed-air guns, which comprises at least two cylinders in series, front and rear, respectively, the front cylinder provided with N identical chambers for housing the shots and with a crown of N teeth intended to be engaged by a mechanism of rotation, the rear cylinder provided with N−1 chambers for housing the shots and with an aperture of smaller diameter intended to make possible the passage of the firing gas from the valve to the chamber of the front cylinder, which is aligned with the barrel from time to time. The front and rear cylinders are provided with complementary couplings, shaped to interact with one another for a contemporary rotation of the two cylinders only after the first N shots have been fired from the front cylinder.

12 Claims, 3 Drawing Sheets

MAGAZINE WITH A PLURALITY OF CYLINDERS IN SERIES, IN PARTICULAR FOR COMPRESSED-AIR GUNS

FIELD OF THE INVENTION

The present invention pertains to the field of guns, in particular compressed-air guns, and it pertains in particular to a new shot magazine for such guns.

BACKGROUND OF THE INVENTION

In the majority of the repeating guns that utilize compressed air or carbon dioxide for firing shot of a non-spherical shape, a multi-chamber (usually eight) cylinder is used as the magazine, each chamber housing a shot in its interior.

After eight shots, the cylinder must then be reloaded. Consequently a cylinder provided with a greater number of chambers is desirable, but this implies an increase in the diameter of the cylinder, in contrast with the requirement of making compressed-air guns more and more similar to real guns.

SUMMARY OF THE INVENTION

The object of the present invention is to propose a magazine particularly for compressed-air guns that makes it possible to have a greater number of bullets compared to the current magazines without an increase in the diameter of the magazine and thus without a significant increase in the dimensions of the gun.

The object is accomplished with a magazine comprising at least two cylinders in series, front and rear, respectively, the front cylinder being provided with N identical chambers for housing said shots to be fired and with a crown of N teeth intended to be engaged by a rotation mechanism of the cylinder controlled by the trigger, the rear cylinder being provided with N−1 chambers for housing said shots and with an aperture of smaller diameter intended to make possible the passage of firing gas by a valve fed by a source of pneumatic energy to the chamber of the front cylinder, from time to time aligned with the barrel. The cylinders are provided with complementary coupling means contemporary of the two cylinders only after the first N shots have been fired by the front cylinder and with means for an initial angular positioning of the rear cylinder in relation to the valve so that the relative aperture is aligned with same for the first N shots, and of the front cylinder in relation to the rear cylinder so that the complementary coupling means make possible the rotation of the front cylinder alone for said first N shots and interact with one another only after said first N shots have been fired.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
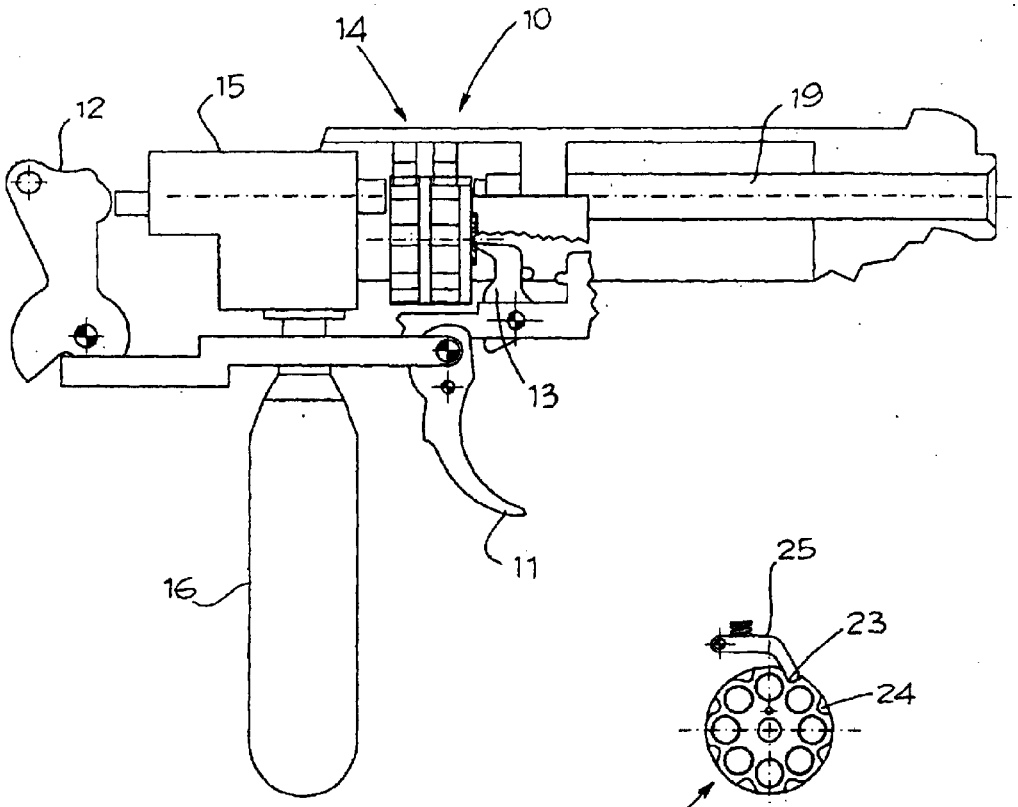
FIG. 1 shows a side schematic view of components of a compressed-air gun which utilizes the magazine according to the present invention.
Figure 5:
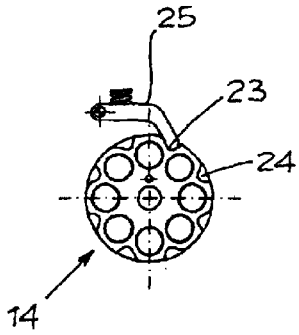
FIG. 5 shows the front cylinder of the magazine viewed from behind.
Figure 4:
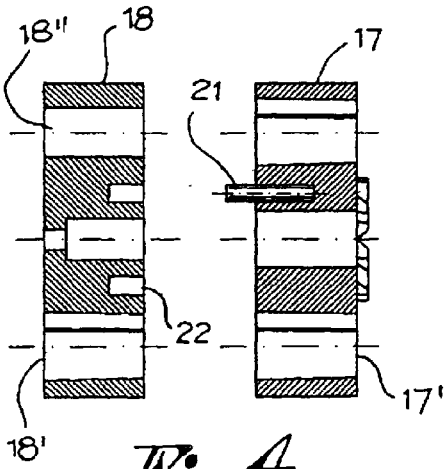
FIGS. 4 and 4*a* show, in axial section, two cylinders that make up the magazine, which are separated from one another and coupled with one another, respectively.
Figure 4A:
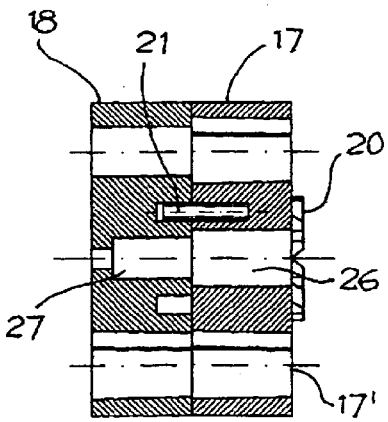
Figures 2, 3:
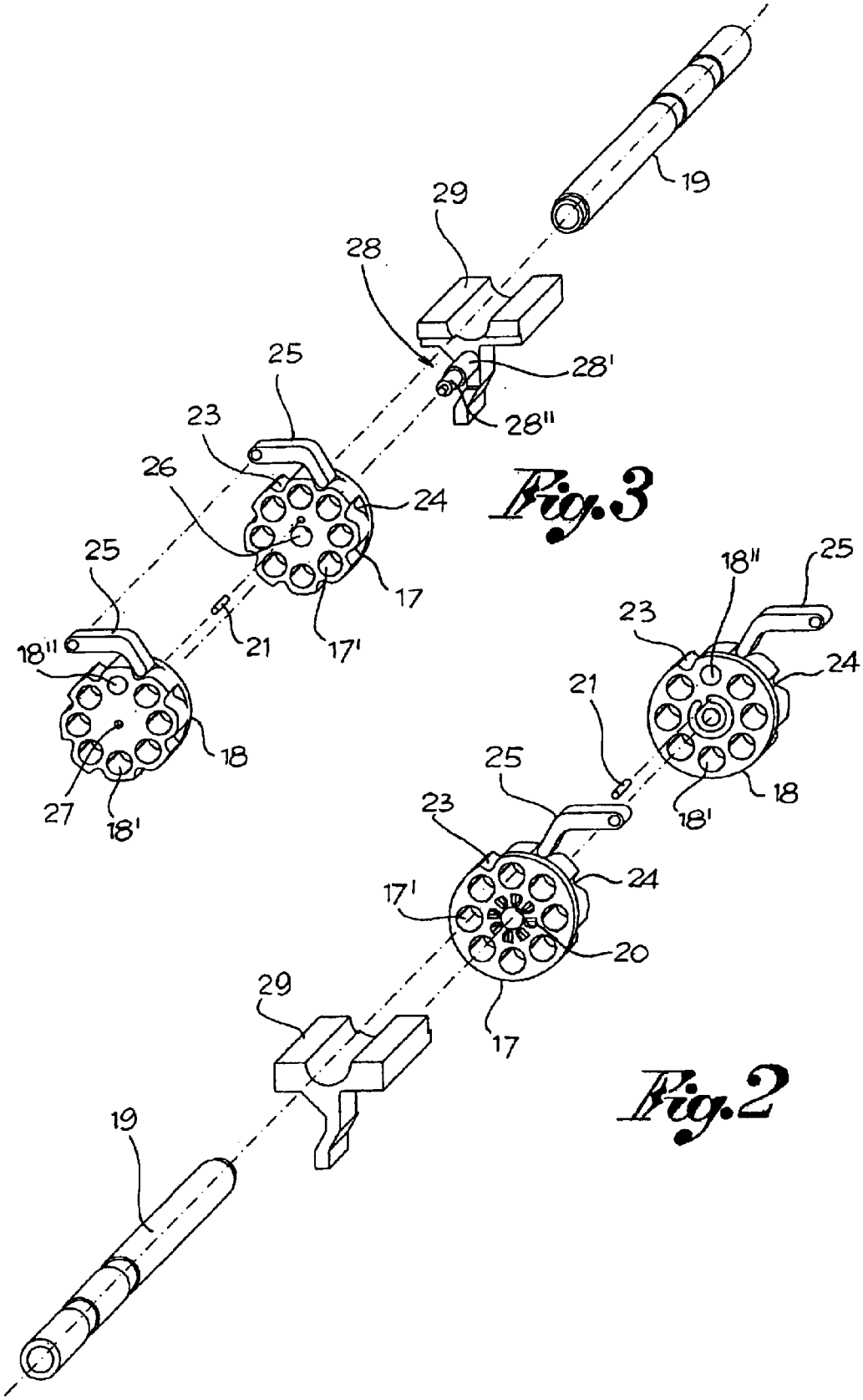
FIG. 2 shows a front, exploded, perspective view of the elements that make up and support the magazine.
FIG. 3 shows a rear, exploded, perspective view of the elements of FIG. 2.
Figure 6:
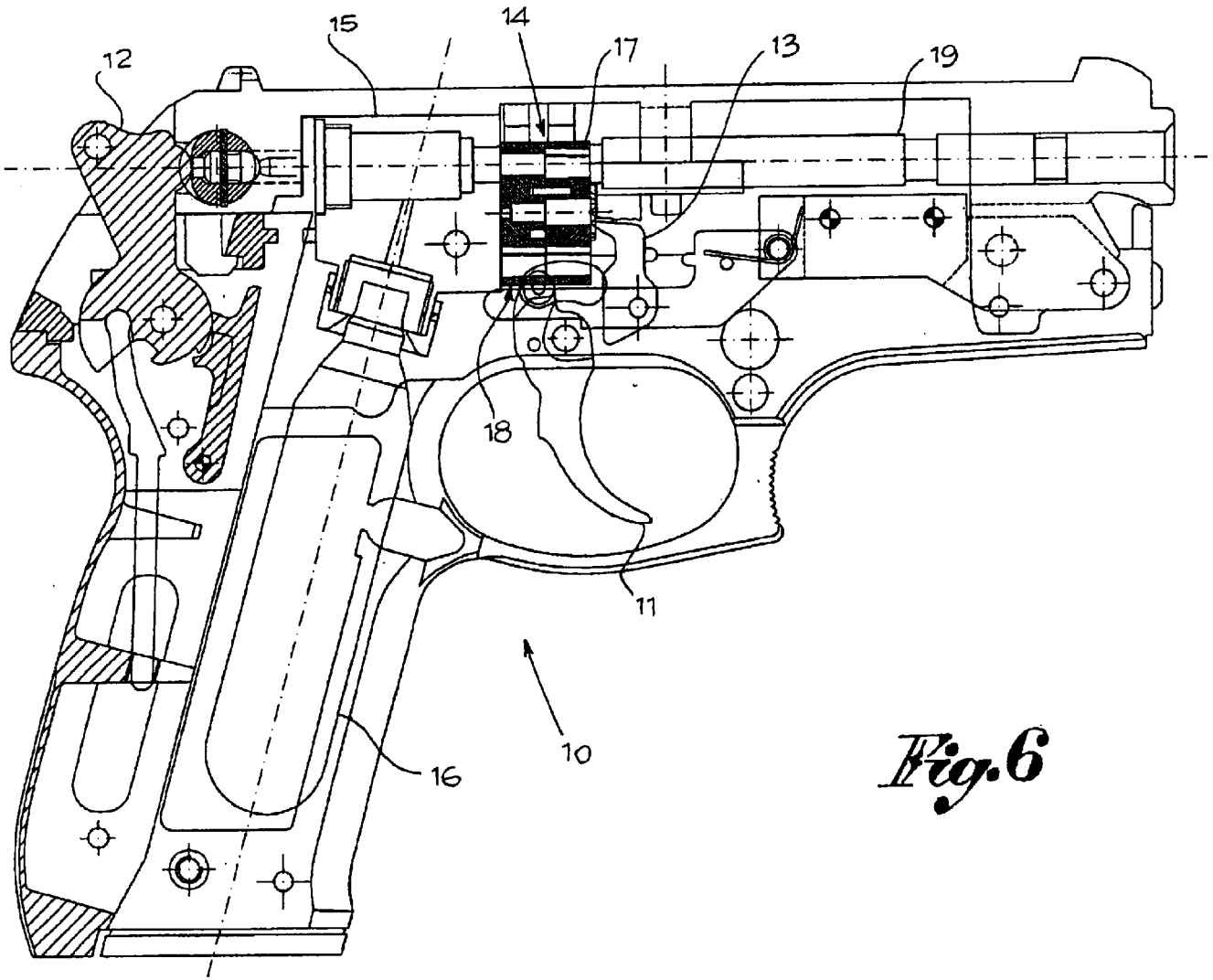
FIG. 6 shows the complete gun in partial section.

Referring to the drawings in particular, A repeating pistol utilizing compressed air or carbon dioxide to fire a non-spherical-shaped, typically foam-plug-shaped shot, is indicated globally by 10 in said drawings.

As is well known, the gun comprises a trigger 11, which cooperates, on the one hand with a firing mechanism 12, and on the other hand, with a mechanism 13 for rotating a magazine of shots 14 that is arranged behind the barrel 19 of the pistol. A valve 15 fed by a pneumatic energy source 16 is provided between the firing mechanism 12 and the magazine 14.

In accordance with the present invention, the magazine 14 consists of two cylinders 17, 18, front and rear, respectively, which are arranged in series, facing one another. The front cylinder 17 is in contact with the barrel 19 of the gun, while the rear cylinder 18 is in contact with the valve 15.

The front cylinder is provided with a number N of identical chambers 17', e.g., eight in the version shown; the rear cylinder 18 is provided with N−1 identical chambers 18' having a diameter equal to that of the chambers 17' of the front cylinder 17, and with an aperture 18", the front cylinder 17 is provided with a crown of N teeth 20 intended to be engaged by the mechanism of rotation 13 of the gun. The front cylinder 17 is additionally provided with a small peg 21 protruding from the rear surface, which is opposite that in which the rotation teeth 20 are located.

The rear cylinder 18, in its surface in contact with the front cylinder 17, is provided with an incomplete, annular groove 22, in which the small peg 21 of the front cylinder 17 is free to slide.

The two cylinders 17, 18 have each a matching, radial, peripheral groove 23, provided, i.e., along their entire thickness, and N−1 identical peripheral notches 24, in which is intended to engage a spring lever 25 associated with each cylinder for making possible from time to time the alignment of the chambers thereof with the barrel 19. The two cylinders 17, 18 are additionally axially passed through by a respective hole 26, 27, the hole 26 of the front cylinder 17 having a greater diameter than the hole 27 of the rear cylinder 18. Said two holes are intended to make possible the mounting of the two cylinders on the shaft 28 of a common support 29, said shaft having a first section 28' of a greater diameter and a second section 28" of a smaller diameter. In this way, it is impossible to invert the mounting sequence of the two cylinders on the support 29. The peripheral groove 23 additionally constrains the two cylinders to be mounted only in a certain angular position, or the rear cylinder 18 with the aperture 18" aligned with the hole for the venting of gases by the valve 15 and the front cylinder 17 with the small peg 21 at one end of the incomplete annular groove 22 of the rear cylinder 18.

With the gun closed, with the two cylinders loaded and correctly mounted on the support 29, with each complete pressure of the trigger 11, the front cylinder 17 rotates one eighth of a turn, while the rear cylinder 18 remains stationary, held back elastically by its alignment lever 25. At the end of the course of the trigger, the firing mechanism 13 allows a certain quantity of gas to be vented by the valve 15. The gas passes through the aperture 18" of the rear cylinder 18 and fires the shot from the front cylinder 17 aligned with said aperture. Continuing to fire, the front cylinder rotates while the rear cylinder remains stationary. Once the eighth shot has also parted, the small peg 21 of the front cylinder 17, which up to this time was siding in the incomplete groove 22 of the rear cylinder 18, reaching capacity, forces the latter to rotate together with the front cylinder 17, overcoming the resistance of the alignment lever proper 25. With each pressure on the trigger, the loaded chambers of the rear cylinder 18 align with spent chambers of the cylinder 17 and consequently with the barrel 19. The shot fired by the gas first passes through the chamber proper, then the chamber of the front cylinder and then the barrel.

The cycle is repeated until depletion of the shots.

It should be noted that the present invention described here for two cylinders in series can be extended to any number of cylinders, since the condition that if the front cylinder has N chambers, other cylinders must have N−1 chambers is met.

While specific embodiments of the invention have been shown and described in detail to illustrate the application of the principles of the invention, it will be understood that the invention may be embodied otherwise without departing from such principles.

What is claimed is:

1. A shot magazine for repeating guns, especially compressed-air guns, in which shots are housed in respective chambers provided in the magazine around an axis of rotation of same, and in which the gun comprises:

a trigger;

a mechanism for rotating the magazine around its own axis, which can be controlled by said trigger for placing a chamber housing a shot in correspondence with a barrel of the gun; and a firing mechanism, which can likewise be controlled by said trigger for acting on a valve for controlling a flow of a firing gas coming from a source of pneumatic energy and to induce firing of the shot, which is aligned with said barrel of the gun, wherein it comprises at least two cylinders in series, front and rear, respectively, said front cylinder being provided with N identical chambers for housing the shots and with a crown of N teeth intended to be engaged by said mechanism of rotation, said rear cylinder being provided with N−1 chambers for housing shots and with an aperture of smaller diameter than said chambers for housing shots, for passage of said firing gas from said valve to a said chamber of said front cylinder, from time to time aligned with the barrel, and complementary coupling means, which are shaped to interact with one another for a contemporary rotation of two cylinders only after the first N shots have been fired by said front cylinder.

2. A magazine in accordance with claim 1, further comprising:

means for initial angular positioning of said rear cylinder in relation to said valve so that said aperture of a smaller diameter for passage of said firing gas is aligned with same for the first N shots, and of said front cylinder in relation to said rear cylinder so that said complementary coupling means make possible rotation of only said front cylinder for same first N shots and interact with one another only after said first N shots have been fired.

3. A magazine in accordance with claim 2, wherein said cylinders are axially passed through by a respective hole to be mounted on a shaft of a common support, said hole of said front cylinder having a greater diameter than said hole of said rear cylinder, said shaft correspondingly having two consecutive sections of different diameter so as to restrict a mounting sequence of said cylinders.

4. A magazine in accordance with claim 2, wherein said means for said angular positioning of said cylinders comprise a radial peripheral groove provided along an entire thickness of each cylinder and a spring lever associated with each cylinder and insertable into said groove when said respective cylinder is mounted in the gun.

5. A magazine in accordance with claim 4, wherein N−1 radial notches, in which said respective spring lever is engagable, are provided along an edge of each cylinder to guarantee an alignment of a chamber containing a shot to be fired with said barrel of the gun from time to time.

6. A magazine in accordance with claim 1, wherein adjacent surfaces of said cylinders comprise a peg, which is extended from a rear surface of said front cylinder and into an incomplete annular groove provided in said rear cylinder and in which said peg is free to slide following the rotation of said front cylinder, said rear cylinder being controlled to rotate together with said front cylinder when said peg reaches an end of said incomplete groove.

7. A magazine of shots for repeating guns, the magazine comprising:

at least two cylinders in series, front and rear, respectively, said front cylinder being provided with N identical chambers for housing shots and with a crown of N teeth engageable by a mechanism of rotation, said rear cylinder being provided with N−1 chambers for housing shots and with an aperture, of smaller diameter than said chambers for housing shots, for passage of a firing gas from a valve to a said chamber of said front cylinder, which is aligned with a barrel of the gun from time to time, said front and rear cylinders being provided with complementary coupling means, interactable with one another for a contemporary rotation of said two cylinders only after the first N shots have been fired from said front cylinder.

8. A magazine in accordance with claim 7, further comprising:

means for initial angular positioning of said rear cylinder in relation to said valve so that said aperture of a smaller diameter for passage of said firing gas is aligned with same for the first N shots, and of said front cylinder in relation to said rear cylinder so that said complementary coupling means make possible rotation of only said front cylinder for same first N shots and interact with one another only after said first N shots have been fired.

9. A magazine in accordance with claim 8, wherein said cylinders are axially passed through by a respective hole to be mounted on a shaft of a common support, said hole of said front cylinder having a greater diameter than said hole of said rear cylinder, said shaft correspondingly having two consecutive sections of different diameter so as to restrict a mounting sequence of said cylinders.

10. A magazine in accordance with claim 8, wherein said means for said angular positioning of said cylinders comprise a radial peripheral groove provided along an entire thickness of each cylinder and a spring lever associated with each cylinder and insertable into said groove when said respective cylinder is mounted in the gun.

11. A magazine in accordance with claim 10, wherein N−1 radial notches, in which said respective spring lever is engagable, are provided along an edge of each cylinder to guarantee an alignment of a chamber containing a shot to be fired with said barrel of the gun from time to time.

12. A magazine in accordance with claim 7, wherein adjacent surfaces of said cylinders comprise a peg, which is extended from a rear surface of said front cylinder and into an incomplete annular groove provided in said rear cylinder and in which said peg is free to slide following the rotation of said front cylinder, said rear cylinder being controlled to rotate together with said front cylinder when said peg reaches an end of said incomplete groove.

* * * * *